US010752429B2

(12) United States Patent
Nishide et al.

(10) Patent No.: US 10,752,429 B2
(45) Date of Patent: Aug. 25, 2020

(54) PACK FOR CONSUMER GOODS AND A PACKAGING BLANK AND A METHOD FOR FOLDING A PACK FOR CONSUMER GOODS

(71) Applicant: JT International S.A., Geneva (CH)

(72) Inventors: Kazuhiro Nishide, Iwata (JP); Oleksandr Zhurba, Trier (DE); Andrew Pearson, Schweich (DE)

(73) Assignee: JT International SA (CH)

( * ) Notice: Subject to any disclaimer, the term of this patent is extended or adjusted under 35 U.S.C. 154(b) by 232 days.

(21) Appl. No.: 15/763,704

(22) PCT Filed: Sep. 29, 2016

(86) PCT No.: PCT/EP2016/073296
§ 371 (c)(1),
(2) Date: Mar. 27, 2018

(87) PCT Pub. No.: WO2017/055474
PCT Pub. Date: Apr. 6, 2017

(65) Prior Publication Data

US 2018/0282056 A1 Oct. 4, 2018

(30) Foreign Application Priority Data

Sep. 30, 2015 (EP) ..... 15187688

(51) Int. Cl.
*B65D 85/10* (2006.01)
*B65D 5/66* (2006.01)
(Continued)

(52) U.S. Cl.
CPC ..... *B65D 85/1045* (2013.01); *B31B 50/26* (2017.08); *B31B 50/624* (2017.08);
(Continued)

(58) Field of Classification Search
CPC .. B65D 85/1045; B65D 5/422; B65D 5/4216; B65D 5/6685; B31B 50/26; B31B 50/624; B31B 2120/102; B31B 2110/35
(Continued)

(56) References Cited

U.S. PATENT DOCUMENTS

D322,687 S * 12/1991 Tschudin ..... D27/189
5,137,148 A * 8/1992 Evers ..... B65D 5/4233 206/271
(Continued)

FOREIGN PATENT DOCUMENTS

EP 1614641 A1 1/2006
GB 1425164 * 2/1976
WO 2014097200 A1 6/2014

OTHER PUBLICATIONS

International Search report and Written Opinion for PCT/EP2016/073296 dated Oct. 31, 2016.
(Continued)

*Primary Examiner* — Ernesto A Grano
(74) *Attorney, Agent, or Firm* — Lerner, David, Littenberg, Krumholz & Mentlik, LLP

(57) ABSTRACT

A lid for a pack for consumer goods, in particular a pack for smoking articles, comprising a container and a lid being pivotable about a hinge with a lid top wall, a lid front wall, a lid back wall and two opposite lid side walls, wherein the lid further comprises a reinforcement structure bonded to a contact surface of the lid top wall comprising a lid top wall counter panel, a first stabilizing flap and a second stabilizing flap, and wherein the reinforcement structure is further configured such that at least a part of an edge of the first stabilizing flap is aligned with at least part of a first edge of the lid top wall counter panel and at least a part of an edge
(Continued)

of the second stabilizing flap is aligned with at least part of a second edge of the lid top wall counter panel.

15 Claims, 6 Drawing Sheets

(51) Int. Cl.

| | |
|---|---|
| ***B65D 5/42*** | (2006.01) |
| ***B31B 50/62*** | (2017.01) |
| ***B31B 50/26*** | (2017.01) |
| *B31B 110/35* | (2017.01) |
| *B31B 120/10* | (2017.01) |

(52) U.S. Cl.
CPC ..... *B65D 5/422* (2013.01); *B65D 5/4216* (2013.01); *B65D 5/6685* (2013.01); *B31B 2110/35* (2017.08); *B31B 2120/102* (2017.08)

(58) Field of Classification Search
USPC ..... 206/268
See application file for complete search history.

(56) References Cited

U.S. PATENT DOCUMENTS

| | | | | | |
|---|---|---|---|---|---|
| 5,160,024 | A * | 11/1992 | Evers | B65D 5/4233 | 206/264 |
| 5,236,084 | A * | 8/1993 | Evers | B65D 5/422 | 206/273 |
| 5,363,955 | A * | 11/1994 | Fleenor | B65D 5/422 | 206/268 |
| 5,738,207 | A * | 4/1998 | Trimani | B65D 85/1045 | 206/268 |
| 5,823,331 | A * | 10/1998 | Manservigi | B65D 85/1045 | 206/268 |
| 2018/0178944 | A1* | 6/2018 | Theis | B65D 85/1045 | |
| 2018/0319575 | A1* | 11/2018 | Mustafa | B65D 85/1045 | |

OTHER PUBLICATIONS

Extended European Search Report for EP1517688.5 dated Jan. 7, 2016.

* cited by examiner

PACK FOR CONSUMER GOODS AND A PACKAGING BLANK AND A METHOD FOR FOLDING A PACK FOR CONSUMER GOODS

CROSS-REFERENCE TO RELATED APPLICATIONS

The present application is a national phase entry under 35 U.S.C. § 371 of International Application No. PCT/EP2016/073296, filed Sep. 29, 2016, published in English, which claims priority from European Patent Application No. 15187688.5 filed Sep. 30, 2015, the disclosures of which are incorporated herein by reference in their entireties.

The present invention relates to a pack for consumer goods, in particular to a pack for smoking articles. The present invention further relates to a packaging blank for folding a pack for consumer goods, in particular a pack for smoking articles. Moreover, the present invention relates to a method for forming such a pack by folding of such a blank.

BACKGROUND OF THE INVENTION

Although the present invention relates to all kinds of packs of consumer goods, the present invention is described exemplary in relation to packs for cigarettes currently made by folding a packaging blank into a hinged-lid pack. Packs of consumer goods commonly show on their visible outside surface printed information comprising for example branding items and consumer oriented information about the goods as well as any legally compulsory information such as, in the case of cigarette packs, compulsory health warnings. This printed information is printed on one side of the packaging blank before forming of the packs by folding of the packaging blank in such a way that the printed side of the packaging blank forms the outer surface of the pack.

In the tobacco and other heavily regulated industries, the legally compulsory information to be printed on the packs is generally increasing and consequently the corresponding surface area on the outer surface of the packs is also increasing. As a consequence the remaining surface area for other consumer directed information such as branding and product information is proportionally decreasing.

Consumer goods manufacturers therefore seek for optimization of the available printing surface area on the packs to communicate product information to consumers while complying with all compulsory legal requirements.

WO 2014/097200 A1 describes a hinge-lid pack for smoking articles, which shall provide additional information visible for its purchaser on an inner surface of the lid top wall of the lid of the pack after the opening of the pack. To provide the additional information on the inner surface of the lid top wall of the lid, the pack comprises a counter panel structure extending from the lid's front wall and being folded inside the lid against the lid's front, top and back walls. However, the pack described in WO 2014/097200 A1 with the special lid is particularly difficult to form and to close due to the additional material layer created by the counter panel structure on the inside of the lid, in particular on the back and top walls. This additional material layer further increases significantly the material costs for manufacturing the pack.

It is therefore the object of the present invention to provide at least one improved opportunity for increasing communication space in a hinge-lid pack with information printed on an inner surface of its lid top wall without the disadvantages listed above.

BRIEF SUMMARY OF THE INVENTION

Various aspects of the invention are listed in independent claims 1 and 8.

The inventive pack for consumer goods, in particular pack for smoking articles, comprises: a container forming a compartment delimited by a container bottom wall from which extend a container front wall, a container back wall and two opposite container side walls each connecting the container front wall with the container back wall, wherein the container front wall, the container back wall and the two container side walls delimit a top opening opposite the container bottom wall which provides access in the compartment, and a lid comprising a lid top wall, a lid front wall, a lid back wall and two opposite lid side walls each connecting the lid front wall with the lid back wall, the lid being pivotable about a hinge to one of the container front wall, container back wall or one of the container side walls between a closed position and an open position, wherein the lid closes the top opening of the container in its closed position while being tilted backward in its open position to allow access to the compartment in the container through the top opening, wherein the lid further comprises a reinforcement structure bonded to a contact surface of the lid top wall comprising: a lid top wall counter panel, extending from the lid front wall, a first stabilizing flap extending from a first lid side wall and a second stabilizing flap extending from a second lid side wall, and wherein the reinforcement structure is further configured such that at least a part of an edge of the first stabilizing flap is aligned with at least part of a first edge of the lid top wall counter panel and at least a part of an edge of the second stabilizing flap is aligned with at least part of a second edge of the lid top wall counter panel.

Furthermore, the inventive packaging blank for folding a pack for consumer goods, in particular a pack for smoking articles, comprises: a lid top wall panel, a lid top wall counter panel, a first stabilizing flap and a second stabilizing flap, wherein the packaging blank is foldable into the pack in a way so that a lid top wall of a lid of the pack comprises the lid top wall panel, the lid top wall counter panel, the first stabilizing flap and the second stabilizing flap and an outer surface of the lid top wall panel forms an outer surface of the lid top wall, and wherein the lid top wall counter panel, the first stabilizing flap and the second stabilizing flap are each bondable directly to a contact surface of the lid top wall panel opposite to the outer surface of the lid top wall panel in a way that at least a part of an edge of the first stabilizing flap is aligned with at least part of a first edge of the lid top wall counter panel and at least a part of an edge of the second stabilizing flap is aligned with at least part of a second edge of the lid top wall counter panel.

Further aspects of the invention are listed in the respective dependent claims.

In a preferred embodiment of the pack at least the lid top wall counter panel comprises an indicium printed on an inner surface of the lid top wall counter panel opposite to the contact surface of the lid top wall to which the lid top wall counter panel is bonded.

In an also preferred embodiment of the pack the lid front wall comprises another reinforcement structure bonded to a lid front wall panel of the lid front wall.

Preferably, the lid top wall counter panel has a rectangular shape and a maximum dimension of the lid top wall counter panel in a direction from the first lid side wall to the second lid side wall is smaller than a maximum distance between the two lid side walls.

In another preferred embodiment of the pack the lid top wall counter panel has a trapezoidal shape with a first base edge adjacent to the lid front wall and a second base edge parallel to and smaller than the first base edge adjacent to the lid back wall.

In an advantageous embodiment of the pack the two lid side walls are each formed of two side flaps.

In a further advantageous embodiment the pack the two container side walls are each formed of two container side flaps.

In a preferred embodiment of the packaging blank, the lid top wall counter panel has a rectangular shape and a maximum dimension of the lid top wall counter panel in a longitudinal direction thereof is smaller than a maximum dimension of the lid top wall panel in a longitudinal direction thereof, and wherein a dimension of the first and the second stabilizing flaps in the longitudinal direction of the blank is substantially equal to 50% of a difference between the maximum dimensions of the lid top wall panel and lid top wall counter panel respectively.

Alternatively, the lid top wall counter panel may have a trapezoidal shape with a larger base edge adjacent to the lid top wall panel and a smaller base edge parallel and opposite the larger base edge, wherein the first and the second stabilizing flaps have a quadrilateral shape with a top free edge configured to align with lateral sides of the lid top wall counter panel upon folding and bonding of the lid top wall counter panel, the first stabilizing flap and the second stabilizing flap to the contact surface of the lid top wall panel.

In another preferred embodiment of the packaging blank, the packaging blank further comprises: a lid front wall panel separated from the lid top wall panel by a first folding line, a lid front wall counter panel separated from the lid front wall panel by a second folding line and separated from the lid top wall counter panel by a third folding line, a lid back wall panel separated from the lid top wall panel by a fourth folding line opposite to the first folding line, a first pair of side flaps being each separated from the lid front wall panel by at least one folding line, a second pair of side flaps, being each separated from the lid back wall panel by at least one folding line, the first stabilizing flap being separated from a first side flap of the second pair by a fifth folding line, and the second stabilizing flap, being separated from a second side flap of the second pair by a sixth folding line.

Preferably the packaging blank further comprises: a container back wall panel separated from the lid back wall panel by a seventh folding line, a container bottom wall panel separated from the container back wall panel by an eighth folding line, a container front wall panel separated from the container bot-tom wall panel by a ninth folding line, a first pair of two container side flaps being each separated from the container back wall panel by at least another folding line, a second pair of two container side flaps being each separated from the container front wall panel by at least another folding line, a first reinforcement tongue separated from a first container side flap of the first pair by a tenth folding line, and a second reinforcement tongue separated from a second container side flap of the first pair by an eleventh folding line.

The present invention further provides a method for forming a pack as described above by folding of one of the disclosed embodiments of the blank, wherein the lid top wall counter panel, the first stabilizing flap and the second stabilizing flap are bonded directly to a contact surface of the lid top wall panel opposite the outer surface of the lid top wall panel such that at least a part of an edge of the first stabilizing flap is aligned with at least part of a first edge of the lid top wall counter panel and at least a part of an edge of the second stabilizing flap is aligned with at least part of a second edge of the lid top wall counter panel.

In a preferred embodiment of the method, the lid front wall counter panel is folded about the second folding line and bonded to the lid front wall panel such that the lid front wall panel forms the outer surface of the lid front wall, a first lid side wall is formed by bonding the first side flap of the first pair and the first side flap of the second pair, and a second lid side wall opposite to the first lid side wall is formed by bonding the second side flap of the first pair and the second side flap of the second pair.

Preferably, a container back wall is formed of the container back wall panel, wherein the lid is linked with the container back wall via a hinge which is realized by the seventh folding line, a container bottom wall is formed by bonding the first reinforcement tongue and the second reinforcement tongue to the container bottom wall panel, a container front wall opposite to the container back wall is formed of the container front wall panel, a first container side wall is formed by bonding of the first container side flap of the first pair and the first container side flap of the second pair, and a second container side wall opposite to the first container side wall is formed by bonding of the second container side flap of the first pair and the second container side flap of the second pair.

In the figures, identical reference signs denote equivalent or functionally equivalent components.

DESCRIPTION OF THE PREFERRED EMBODIMENTS

Figure 1A:
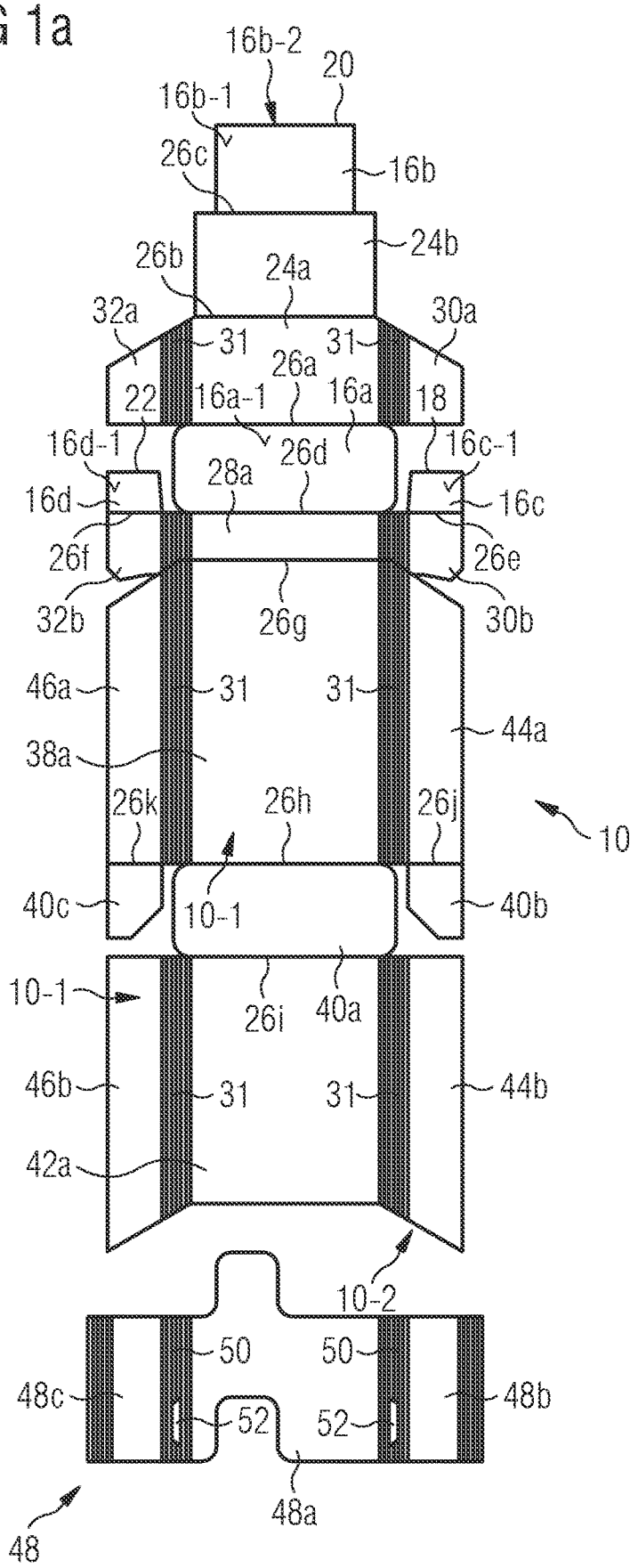
FIGS. 1*a* and 1*b* are a plan view of a first embodiment of a packaging blank for folding a pack for consumer goods and a perspective view of a pack formed of the packaging blank.
Figure 1B:
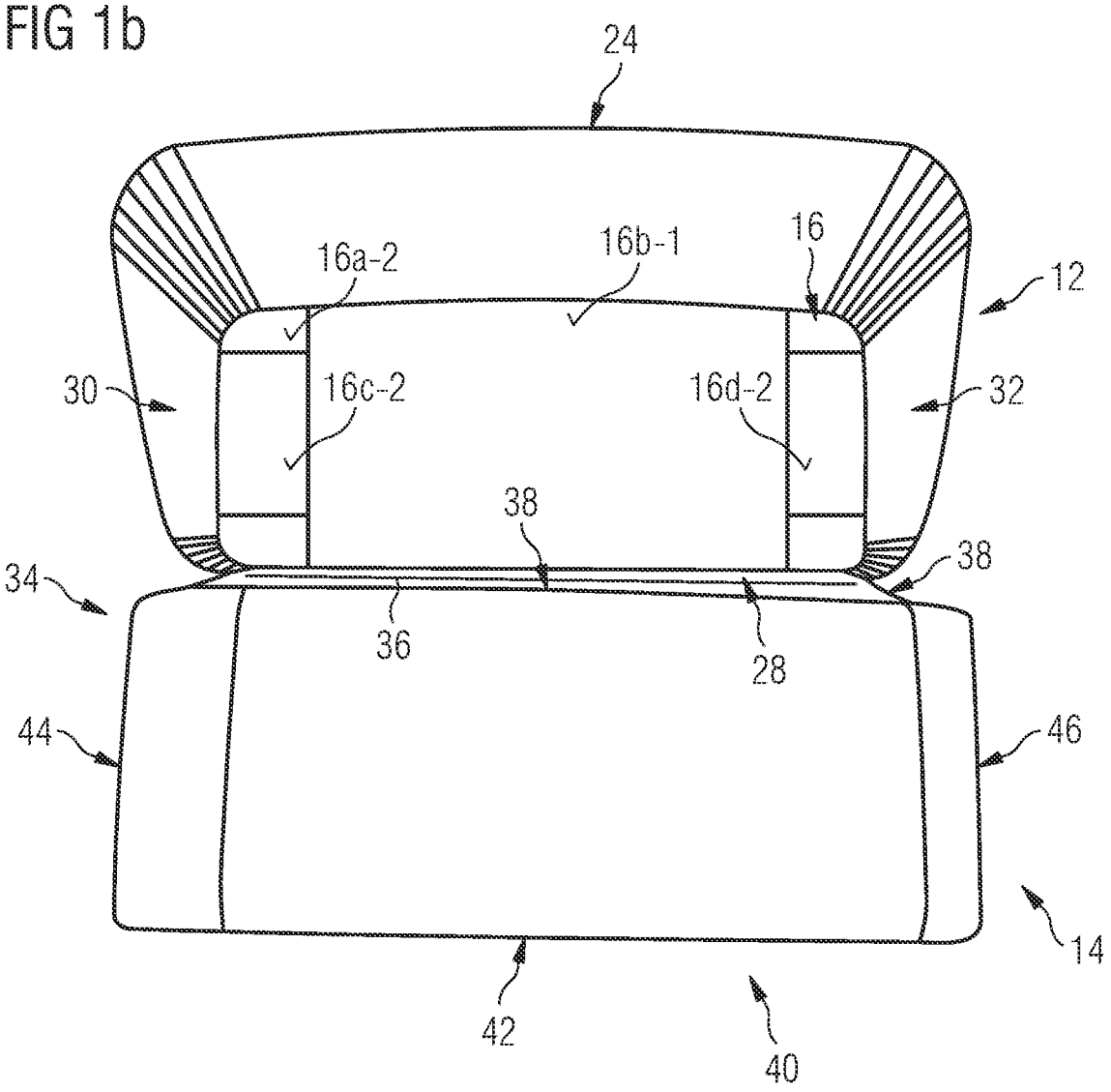

FIGS. 1*a* and 1*b* are a plan view of a first embodiment of a packaging blank for folding a pack for consumer goods and a perspective view of a pack formed of the packaging blank.

The packaging blank 10 shown in FIG. 1*a* may be made of cardboard, for instance. The packaging blank 10 has a first blank side 10-1 and a second blank side 10-2. The first blank side 10-1 may be prepared in a way that ensures a good print quality when at least one indicium (e.g. at least one letter and/or symbol) is printed on the first blank side 10-1. Opposite the first blank side 10-1, the second blank side 10-2 may or may not be printed. Preferably, the packaging blank 10 has a somewhat constant blank thickness d (not shown in FIG. 1*a*).

The packaging blank 10 is foldable into a pack 14 for consumer goods, and in particular a pack 14 for smoking articles, such as cigarettes, cigarillos, cigars, and the like. Such items may be simply referred to as "smoking articles". However, the present invention is not restricted to cigarette packaging. Instead, the packaging blank 10 may be used for packaging any consumer goods.

The packaging blank 10 comprises at least a lid top wall panel 16*a*, a lid top wall counter panel 16*b*, a first stabilizing flap 16*c* and a second stabilizing flap 16*d*. The packaging blank 10 is foldable into the pack 14 in a way so that a lid top wall 16 of a lid 12 of the pack 14 comprises the lid top wall panel 16*a*, the lid top wall counter panel 16*b*, the first stabilizing flap 16*c* and the second stabilizing flap 16*d*.

An inside of the lid 12 of the pack 14 obtained from folding the packaging blank 10 of FIG. 1*a* is shown in FIG. 1*b*. An outer surface 16*a*-1 of the lid top wall panel 16*a* forms an outer surface of the lid top wall 16, which is not shown in FIG. 1*b*. The lid top wall counter panel 16*b*, the first stabilizing flap 16*c* and the second stabilizing flap 16*d* are each bondable/bonded directly to a contact surface 16*a*-2 of the lid top wall panel 16*a* (opposite to the outer surface 16*a*-1 of the lid top wall panel 16*a*). As can be seen in FIG. 1*b*, the lid top wall counter panel 16*b*, the first stabilizing flap 16*c* and the second stabilizing flap 16*d* are each bonded directly to the contact surface 16*a*-2 of the lid top wall panel 16*a* in a way that at least a part of an edge 18 of the first stabilizing flap 16*c* is aligned with at least part of a first edge 20 of the lid top wall counter panel 16*b*. (The edge 18 of the first stabilizing flap 16*c* is defined as being between a contact surface 16*c*-1 of the first stabilizing flap 16*c* contacting the contact surface 16*a*-2 of the lid top wall panel 16*a* and an inner surface 16*c*-2 of the first stabilizing flap 16*c* facing the inside of the lid 12. Similarly, first/second edge 20 of the lid top wall counter panel 16*b* is defined as being between a contact surface 16*b*-2 of the lid top wall counter panel 16*b* contacting the contact surface 16*a*-2 of the lid top wall panel 16*a* and an inner surface 16*b*-1 of the lid top wall counter panel 16*b*.) Moreover, at least a part of an edge 22 of the second stabilizing flap 16*d* is aligned with at least part of a second edge 20 of the lid top wall counter panel 16*b*. (The edge 22 of the second stabilizing flap 16*d* is defined as being between a contact surface 16*d*-1 of the second stabilizing flap 16*d* contacting the contact surface 16*a*-2 of the lid top wall panel 16*a* and an inner surface 16*d*-2 of the second stabilizing flap 16*d* facing the inside of the lid 12.)

Thus, the lid top wall counter panel 16*b*, the first stabilizing flap 16*c* and the second stabilizing flap 16*d* together form a single layer with a layer thickness substantially equal to the blank thickness d. The total thickness of the lid top wall 16 is therefore only twice the blank thickness d plus a thickness of an adhesive layer between the lid top wall panel 16*a* and the components 16*b* to 16*d*. The thickness of the lid 12 shown in FIG. 1*b* is therefore substantially the same of the one of a standard hinge-lid package of smoking articles which does not comprise any counter panel 16*b* (and has further a thinner lid top wall 16 compared to the prior art). Thus, closure of the pack 14 with the lid 12 is as easy as with any standard pack of smoking articles.

Moreover, as can be seen in FIG. 1*b*, the edge 18 of the first stabilizing flap 16*c* and the edge 22 of the second stabilizing flap 16*d* each directly contact the edges 20 of the lid top wall counter panel 16*b*. Thus, the edge 18 of the first stabilizing flap 16*c* and the edge 22 of the second stabilizing flap 16*d* each rest against the edges 20 of the lid top wall counter panel 16*b*. This resting of the edges 18 and 22 of the two stabilizing flaps 16*c* and 16*d* against the edges 20 of the lid top wall counter panel 16*b* further increases mechanical stability of the lid 12. The lid 12 therefore shows an increased resistance against any pressure/force performed on the lid 12 compared to standard smoking article packages, especially against any pressure/force performed on the outer surface of the lid top wall 16 and of any side wall of the lid 12.

Furthermore, as the contact surface 16*b*-2 of the lid top wall counter panel 16*b* is directly bonded to the contact surface 16*a*-2 of the lid top wall panel 16*a*, the inner surface 16*b*-1 of the lid top wall counter panel 16*b* advantageously faces the inside of the lid 12 and thereby provides an inner printed area within the lid 12 where at least one letter, symbol and/or whatever other indicium is visible to a user on the inner surface 16*b*-1 of the lid top wall counter panel 16*b*, when the pack 14 is opened.

The embodiment of FIGS. 1*a* and 1*b* therefore makes it easier to provide said pack 14 with printed information required to inform consumers sufficiently as the lid top wall counter panel 16*b* added to the lid top wall 16 provides additional printing space on the pack 14 compared to standard hinge-lid packages.

Moreover, as the at least one indicium (e.g. at least one letter and/or symbol) on the inner surface 16*b*-1 of the lid top wall counter panel 16*b* is printed on the first blank side 10-1 (of the unfolded packaging blank 10), the at least one indicium on the inner surface 16*b*-1 of the lid top wall counter panel 16*b* has a good printing quality. Furthermore, the first blank side 10-1 may also be used for (almost) all outside surfaces of the pack 14. It is therefore possible to provide the at least one indicium on the inner surface 16*b*-1 of the lid top wall counter panel 16*b* together with all the other prints of the outside surfaces of the pack 14 by performing only one printing pass, in which only the first blank side 10-1 (of the unfolded packaging blank 10) is printed. Thus, the second blank side 10-2 does need to be printed to show information on the inside of the lid 12.

In the embodiment of FIG. 1*a* the packaging blank 10 comprises the lid top wall panel 16*a*, a lid front wall panel 24*a* (separated from the lid top wall panel 16*a* by a first folding line 26*a*), a lid front wall counter panel 24*b* (separated from the lid front wall panel 24*a* by a second folding line 26*b*) and the lid top wall counter panel 16*b* (separated from the lid front wall counter panel 24*b* by a third folding line 26*c*). The lid 12 formed of the packaging blank 10 comprises a lid front wall 24, wherein the lid front wall 24 is formed of the lid front wall panel 24*a* (on an outer side of lid front wall 24) and the lid front wall counter panel 24*b* (on an inner side of lid front wall 24).

As can be seen in FIG. 1*a*, the packaging blank 10 also comprises a lid back wall panel 28*a*, which is separated from the lid top wall panel 16*a* by a fourth folding line 26*d* (opposite to the first folding line 26*a*). Thus, it is possible to provide the lid 12 with a lid back wall 28 (opposite to the lid front wall 24) formed of the lid back wall panel 28*a*.

To fold the packaging blank 10, it is also advantageous that the packaging blank 10 comprises a first pair of two side flaps 30*a* and 32*a*, each side flap 30*a* and 32*a* of the first pair being separated from the lid front wall panel 24*a* (located between the first pair of two side flaps 30*a* and 32*a*) by at least another folding line 31, and a second pair of two side flaps 30*b* and 32*b*, each side flap 30*b* and 32*b* of the second pair being separated from the lid back wall panel 28*a* (located between the second pair of two side flaps 30*b* and 32*b*) by at least another folding line 31. This makes it easy to provide the lid 12 of the pack 14 formed of the packaging blank 10 with a first lid side wall 30 formed of a first side flap 30*a* of the first pair and a first side flap 30*b* of the second pair and a second lid side wall 32 (opposite to the first lid side wall 30) formed of a second side flap 32*a* of the first pair and a second side flap 32*b* of the second pair.

In the embodiment of FIGS. 1*a* and 1*b* the first stabilizing flap 16*c* is separated from the first side flap 30*b* of the second pair by a fifth folding line 26*e* and the second stabilizing flap 16*d* is separated from the second side flap 32*b* of the second pair by a sixth folding line 26*f*. However, in another embodiment it is also possible to provide the first stabilizing flap 16*c* adjacent to the first side flap 30*a* of the first pair and/or the second stabilizing flap 16*d* adjacent to the second side flap 32*a* of the first pair.

The packaging blank 10 shown in FIG. 1*a* is designed for forming the pack 14 in a way that the lid 12 is linked with a container 34 of the pack 14 via a hinge 36 so that the lid 12 is rotatable relative to the container 34 between an open position and a closed position such as with standard hinge-lid packages. FIG. 1*b* shows the pack 14 comprising the lid 12 and the container 34 with the lid being in its open position. Thus, a purchaser of the pack 14 is able to take an item out of the pack 14 through an open side of the container 34. The open side of the container 34 is covered by the lid 12 when the lid 12 is in its closed position (not shown). To provide the advantageous linkage of the lid 12 to the container 34 via the hinge 36, the packaging blank 10 further comprises a container back wall panel 38*a*, which is separated from the lid back wall panel 28*a* by a seventh folding line 26*g*. It is thus possible to form a container back wall 38 of the container 34 of the container back wall panel 38*a*. Moreover, the seventh folding line 26*g* also serves hinge 36 for articulating the lid 12 onto the container 34.

The packaging blank 10 may also comprise a container bottom wall panel 40*a* (separated from the container back wall panel 30*a* by an eighth folding line 26*h*) and a container front wall panel 42*a* (separated from the container bottom wall panel 40*a* by a ninth folding line 26*i*). Thus, it is possible to form a container bottom wall 40 at least partially of the container bottom wall panel 40*a* and a container front wall 42 (opposite to the container back wall 38) of the container front wall panel 42*a*. The packaging blank 10 shown in FIG. 1*a* also comprises a first pair of two container side flaps 44*a* and 46*a*, wherein each container side flap 44*a* and 46*a* of the first pair is separated from the container back wall panel 38*a* (located between the first pair of two container side flaps 44*a* and 46*a*) by at least another folding line 31, and a second pair of two container side flap 44*b* and 46*b*, wherein each container side flap 44*b* and 46*b* of the second pair is separated from the container front wall panel 42*a* (located between the second pair of two container side flaps 44*b* and 46*b*) by at least another folding line 31. This facilitates the formation of a first container side wall 44, which comprises a first container side flap 44*a* of the first pair and a first container side flap 44*b* of the second pair, and a second container side wall 46 (opposite to the first container side wall 44), which comprises a second container side flap 46*a* of the first pair and a second container side flap 46*b* of the second pair.

Finally, a first reinforcement tongue 40*b* may be separated from the first container side flap 44*a* of the first pair by a tenth folding line 26*j* and a second reinforcement tongue 40*c* may be separated from the second container side flap 46*a* of the first pair by an eleventh folding line 26*k*. (The first reinforcement tongue 40*b* may also be adjacent to the first container side flap 44*b* of the second pair and/or the second reinforcement tongue 40*c* may be adjacent to the second container side flap 46*b* of the second pair.) In all these cases it is possible to form the container bottom wall 40 of the container bottom wall panel 40*a*, the first reinforcement tongue 40*b* and the second reinforcement tongue 40*c*. An outer surface of the container bottom wall panel 40*a* may form an outer surface of the container bottom wall 40, while the first reinforcement tongue 40*b* and the second reinforcement tongue 40*c* are bonded to a contact surface of the container bottom wall panel 40*a*. Thus, a good stability of the container bottom wall 40 is ensured.

In the example of FIGS. 1*a* and 1*b*, the first folding line 26*a* is parallel to the third folding line 26*c* (before the folding of the packaging blank 10). Especially, all folding lines 26*a* to 26*k* may be parallel to each other before the folding of the packaging blank 10 into the pack 14. Moreover, as can be seen in FIG. 1*a*, a maximum dimension, for instance the length, of the lid top wall counter panel 16*b* parallel to the third folding line 26*c* may be smaller than a maximum dimension or length of the top lid wall panel 16*a* parallel to the first folding line 26*a*, i.e. in the longitudinal direction of the top lid wall panel 16*a* and lid top wall counter panel 16*b*. This ensures that a "rest" area of the contact surface 16*a*-2 of the lid top wall panel 16*a* which is not covered by the contact surface 16*b*-2 of the lid top wall counter panel 16*b* is sufficient for the bonding of the two stabilizing flaps 16*c* and 16*b* in a way that the edge 18 of the first stabilizing flap 16*c* and the edge 22 of the second stabilizing flap each contact the edges 20 of the lid top wall counter panel 16*b*. Furthermore, the maximum dimension of the lid top wall counter panel 16*b* parallel to the third folding line 26*c* may be smaller than the maximum dimension of the lid front wall counter panel 24*b* (as is shown in FIG. 1*a*). Preferably, the lid top wall counter panel 16*b* has a rectangular form.

As can be seen in FIG. 1*b*, the lid 12 and the container 14 may be formed with round corners, wherein each round corner is located between two adjacent lid walls 24, 28, 30 and 32/container walls 38, 42, 44 and 46. This is possible by inserting several folding lines 31 between each side flap 30*a*, 30*b*, 32*a*, 32*b*, 44*a*, 44*b*, 46*a* and 46*b* and its adjacent panel 24*a*, 28*a*, 38*a* and 42*a*.

The pack 14 may also comprise a frame, which is folded in a U-shape and connected to the inside of the container 34 in such a way as to protrude partly from the open side of the container 34 and to contact an inside of the lid 12 when the lid 12 is in the closed position. FIG. 1*a* therefore also shows a blank 48 for folding the frame. As can be seen in FIG. 1*a*, the blank 48 may comprise a frame panel 48*a* and two frame side flaps 48*b* and 48*c* on each side of the frame panel 48*a*. To provide round corners between the frame panel 48*a* and each frame side flap 48*b* and 48*c* after folding the frame, several folding lines 50 may be arranged between the frame panel 48*a* and each of its frame side flaps 48*b* and 48*c*. Moreover, the frame preferably has a pair of protuberances 52 (between the folding lines 31) which protrude outward to cause a friction when the lid 12 is in its closed position.

Figure 2:
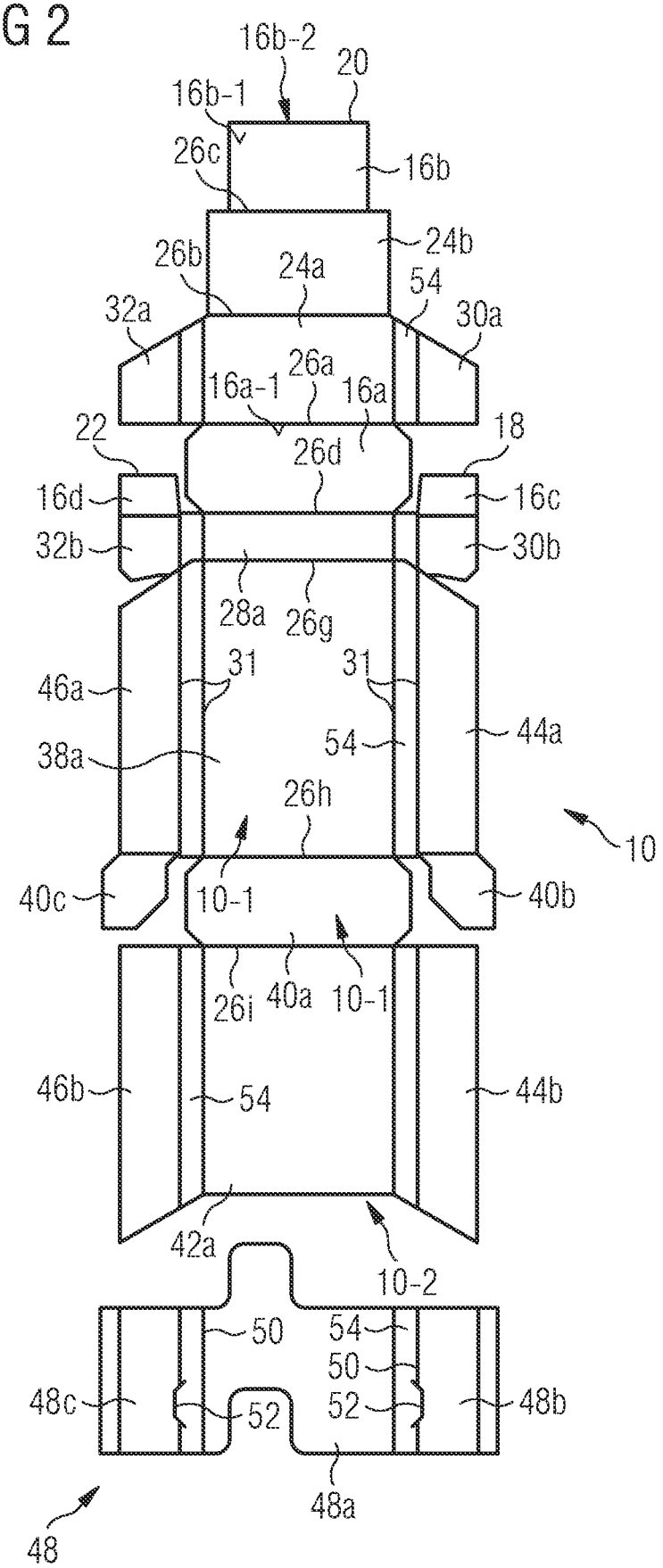
FIG. 2 is a plan view of a second embodiment of a packaging blank for folding a pack for consumer goods.

FIG. 2 is a plan view of a second embodiment of a packaging blank for folding a pack for consumer goods.

In the embodiment of FIG. 2, each side flap 30*a*, 30*b*, 32*a*, 32*b*, 44*a*, 44*b*, 46*a* and 46*b* is separated from its adjacent panel 24*a*, 28*a*, 38*a* and 42*a* by two folding lines 31 and an intermediate zone 54 (between the two folding lines 31). Thus, it is possible to form the pack 14 with an octagonal lid top wall 16 and an octagonal container bottom wall 40. It is further possible to form the pack 14 in a (strict) square form by providing only one folding line 31 between each side flap 30*a*, 30*b*, 32*a*, 32*b*, 44*a*, 44*b*, 46*a* and 46*b* and its adjacent panel 24*a*, 28*a*, 38*a* and 42*a*.

Figure 3A:
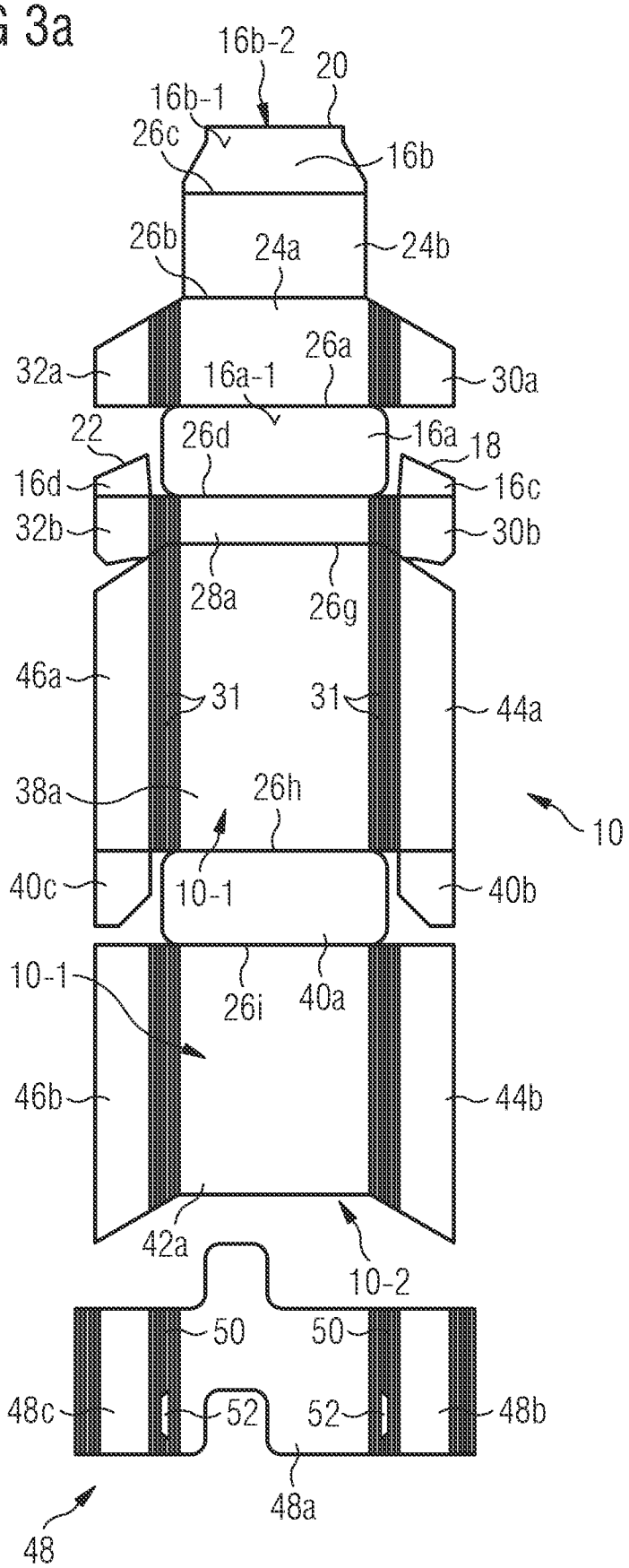
FIGS. 3*a* and 3*b* are a plan view of a third embodiment of a packaging blank for folding a pack for consumer goods and a perspective view of a pack formed of the packaging blank.
Figure 3B:
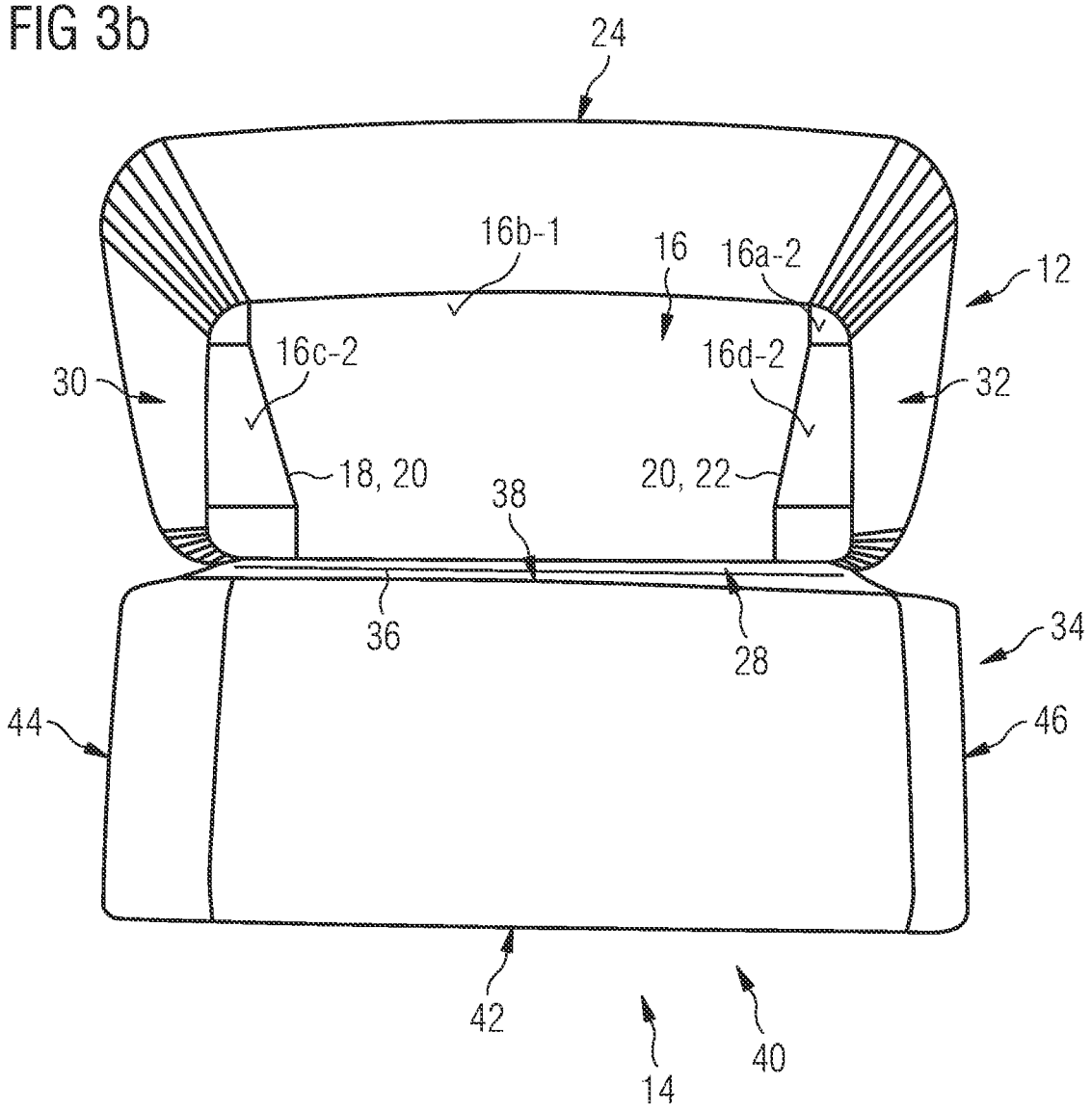

FIGS. 3*a* and 3*b* are a plan view of a third embodiment of a packaging blank for folding a pack for consumer goods and a perspective view of a pack formed of the packaging blank.

The embodiment of FIGS. 3*a* and 3*b* differs from the example of FIGS. 1*a* and 1*b* in the form of the lid top wall counter panel 16*b* and the stabilizing flaps 16*c* and 16*d*. In the embodiment of FIGS. 3*a* and 3*b* the inner surface 16*b*-1 and the contact surface 16*b*-2 of the lid top wall counter panel 16*b* are both trapezoidal. Before the folding of the packaging blank 10, the lid top wall counter panel 16*b* has a first base edge adjacent to the third folding line 26*c* and a second base edge parallel to and smaller than the first base edge at an end of the lid top wall counter panel 16*b* opposite to the third folding line 26*c*. Moreover the stabilizing flaps 16*c* and 16*d* are slanted/trapezoidal. Again, the outer surface 16*a*-1 of the lid top wall panel 16*a* forms the outer surface of the lid top wall 16. The lid top wall counter panel 16*b*, the first stabilizing flap 16*c* and the second stabilizing flap 16*d* are each bonded directly to a contact surface 16*a*-2 of the lid top wall panel 16*a* (opposite to the outer surface 16*a*-1 of the lid top wall panel 16*a*) in a way that at least a part of an edge 18 of the first stabilizing flap 16*c* is aligned with at least part of a first edge 20 of the lid top wall counter panel 16*b* and at least a part of an edge 22 of the second stabilizing flap 16*d* is aligned with at least part of a second edge 20 of the lid top wall counter panel 16*b*. This is especially ensured by the slanted/trapezoidal form of the stabilizing flaps 16*c* and 16*d* and the form of the lid top wall counter panel 16*b* (after their bonding directly to the contact surface 16*a*-2 of the lid top wall panel 16*a*).

Figure 4:
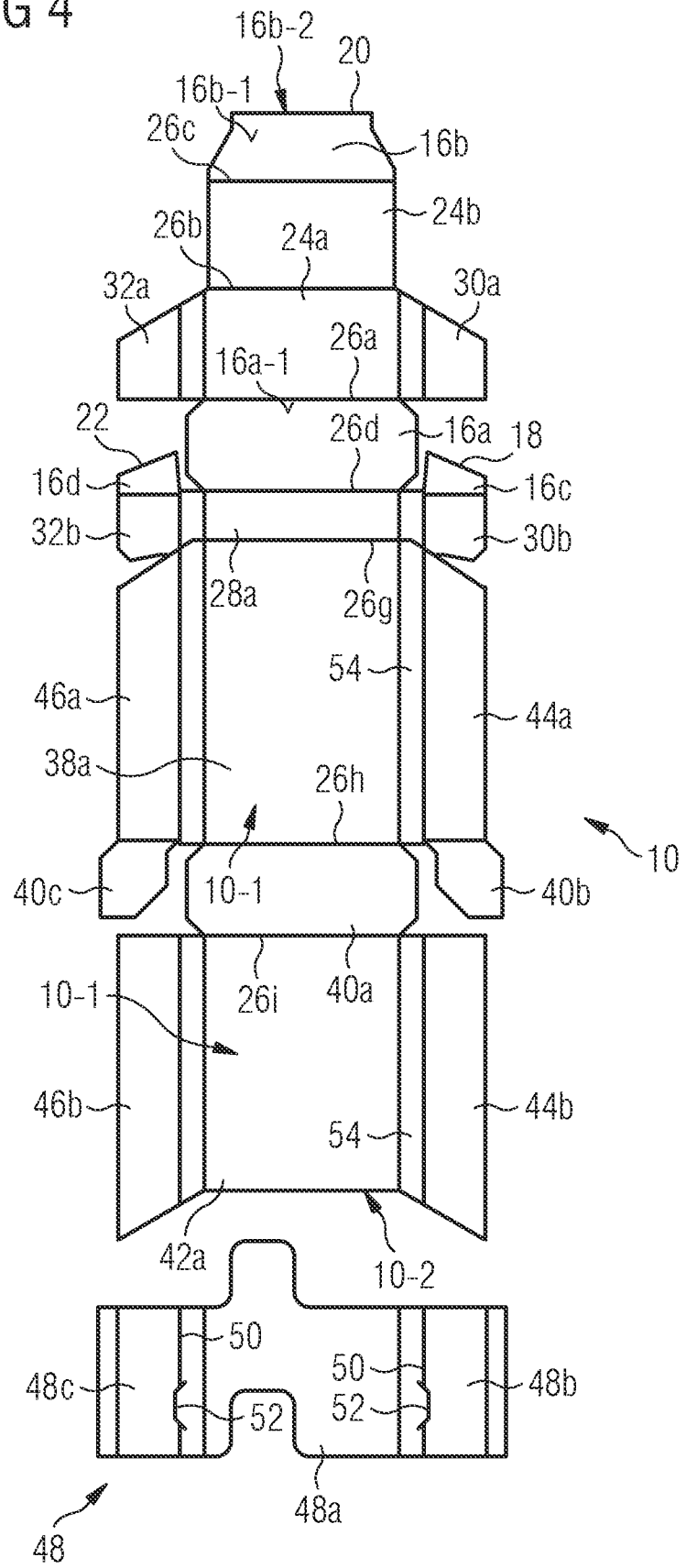
FIG. 4 is a plan view of a fourth embodiment of a packaging blank for folding a pack for consumer goods.

FIG. 4 is a plan view of a fourth embodiment of a packaging blank for folding a pack for consumer goods.

The packaging blank 10 shown in FIG. 4 differs from the embodiment of FIG. 3 only in the number of the folding lines 31 separating each side flap 30*a*, 30*b*, 32*a*, 32*b*, 44*a*, 44*b*, 46*a* and 46*b* from its adjacent panel 24*a*, 28*a*, 38*a* and 42*a*.

All embodiments describe above have a lid top wall counter panel 16*b* which is directly bonded to the lid top wall panel 16*a*. Moreover, reducing/adjusting the stabilizing flaps 16*c* and 16*d* (to allow their direct bonding to the contact surface 16*a*-2 of the lid top wall panel 16*a* in a way that their edges 18 and 22 contact the edges 20 of the lid top wall counter panel 16*b*) improves the lid stability significantly. This further ensures an increase of the lid rigidity, so that the lid 12 keeps its shape.

LIST OF REFERENCE SIGNS

10 packaging blank
10-1 first blank side
10-2 second blank side
12 lid
14 pack
16 lid top wall
16*a* lid top wall panel
16*a*-1 outer surface
16*a*-2 contact surface
16*b* lid top wall counter panel
16*b*-1 inner surface
16*b*-2 contact surface
16*c* first stabilizing flap
16*d* second stabilizing flap
18 to 22 edges
24 lid front wall
24*a* lid front wall panel
24*b* side front wall counter panel
26*a* to 26*k* folding lines
28 lid back wall
28*a* lid back wall panel
30 first lid side wall
30*a* and 30*b* side flaps
31 folding lines
32 second lid side wall
32*a* and 32*b* side flaps
34 container
36 hinge
38 container back wall
38*a* container back wall panel
40 container bottom wall
40*a* container bottom wall panel
42 container front wall
42*a* container front wall panel
44 first container side wall
44*a* and 44*b* container side flap
46 second container side wall
46*a* and 46*b* container side flap
48 blank
48*a* frame panel
48*b* and 48*c* frame side flaps
50 folding lines
52 protuberances
54 intermediate zones

What is claimed is:

1. A pack for consumer goods, in particular a pack for smoking articles, comprising:

a container forming a compartment delimited by a container bottom wall from which extend a container front wall, a container back wall and two opposite container side walls each connecting the container front wall with the container back wall, wherein the container front wall, the container back wall and the two container side walls delimit a top opening opposite the container bottom wall which provides access in the compartment; and a lid comprising a lid top wall, a lid front wall, a lid back wall and two opposite lid side walls each connecting the lid front wall with the lid back wall, the lid being pivotable about a hinge to one of the container front wall, the container back wall, or one of the container side walls between a closed position and an open position, wherein the lid closes the top opening of the container in its closed position while being tilted backward in its open position to allow access to the compartment in the container through the top opening;

wherein the lid further comprises a reinforcement structure bonded to a contact surface of the lid top wall comprising:

a lid top wall counter panel, extending from the lid front wall or the lid back wall, and a first stabilizing flap extending from a first lid side wall of the two lid side walls and a second stabilizing flap extending from a second lid side wall of the two lid side walls;

and wherein the reinforcement structure is further configured such that at least a part of a peripheral edge of the first stabilizing flap faces at least part of a first peripheral edge of the lid top wall counter panel and at least a part of a peripheral edge of the second stabilizing flap faces at least part of a second peripheral edge of the lid top wall counter panel.

2. The pack of claim 1, wherein at least the lid top wall counter panel comprises an indicium printed on an inner surface of the lid top wall counter panel opposite the contact surface of the lid top wall to which the lid top wall counter panel is bonded.

3. The pack of claim 1, wherein the lid front wall comprises another reinforcement structure bonded to a lid front wall panel of the lid front wall.

4. The pack of claim 1, wherein the lid top wall counter panel has a rectangular shape and a maximum dimension of the lid top wall counter panel in a direction from the first lid side wall to the second lid side wall is smaller than a maximum distance between the two lid side walls.

5. The pack claim 1, wherein the lid top wall counter panel has a trapezoidal shape with a first base edge adjacent to the lid front wall and a second base edge parallel to and smaller than the first base edge adjacent to the lid back wall.

6. The pack of claim 1, wherein the two lid side walls are each formed of two side flaps.

7. The pack of claim 1, wherein the two container side walls are each formed of two container side flaps.

8. A packaging blank for folding a pack for consumer goods, in particular a pack for smoking articles, comprising:

a lid top wall panel, a lid top wall counter panel, a first stabilizing flap and a second stabilizing flap;

wherein the packaging blank is foldable into the pack in a way so that a lid top wall of a lid of the pack comprises the lid top wall panel, the lid top wall counter panel, the first stabilizing flap and the second stabilizing flap and an outer surface of the lid top wall panel forms an outer surface of the lid top wall;

and wherein the lid top wall counter panel, the first stabilizing flap and the second stabilizing flap are each bondable directly to a contact surface of the lid top wall panel opposite to the outer surface of the lid top wall panel in a way that at least a part of a peripheral edge of the first stabilizing flap abuts at least part of a peripheral first edge of the lid top wall counter panel and at least a part of a peripheral edge of the second stabilizing flap abuts at least part of a peripheral second edge of the lid top wall counter panel.

9. The packaging blank of claim 8, wherein the lid top wall counter panel has a rectangular shape and a maximum dimension of the lid top wall counter panel in a longitudinal direction thereof is smaller than a maximum dimension of the lid top wall panel in a longitudinal direction thereof, and wherein a dimension of the first and the second stabilizing flaps in a longitudinal direction of the blank is substantially equal to 50% of a difference between the maximum dimensions of the lid top wall panel and lid top wall counter panel respectively.

10. The packaging blank of claim 8, wherein the lid top wall counter panel has a trapezoidal shape with a larger base edge adjacent to the lid top wall panel and a smaller base edge parallel and opposite the larger base edge, and wherein the first and the second stabilizing flaps each have a quadrilateral shape with a top free edge configured to align with lateral sides of the lid top wall counter panel upon folding and bonding of the lid top wall counter panel, the first stabilizing flap and the second stabilizing flap to the contact surface of the lid top wall panel.

11. The packaging blank of claim 8, wherein the packaging blank further comprises:

a lid front wall panel separated from the lid top wall panel by a first folding line;

a lid front wall counter panel separated from the lid front wall panel by a second folding line and separated from the lid top wall counter panel by a third folding line;

a lid back wall panel separated from the lid top wall panel by a fourth folding line opposite to the first folding line;

a first pair of side flaps being each separated from the lid front wall panel by at least one folding line;

a second pair of side flaps, being each separated from the lid back wall panel by at least one folding line;

the first stabilizing flap being separated from a first side flap of the second pair by a fifth folding line; and the second stabilizing flap, being separated from a second side flap of the second pair by a sixth folding line.

12. The packaging blank of claim 11, wherein the packaging blank further comprises:

a container back wall panel separated from the lid back wall panel by a seventh folding line;

a container bottom wall panel separated from the container back wall panel by an eighth folding line;

a container front wall panel separated from the container bottom wall panel by a ninth folding line;

a first pair of two container side flaps being each separated from the container back wall panel by at least another folding line;

a second pair of two container side flaps being each separated from the container front wall panel by at least another folding line;

a first reinforcement tongue separated from a first container side flap of the first pair by a tenth folding line; and a second reinforcement tongue separated from a second container side flap of the first pair by an eleventh folding line.

13. A method for forming a pack by folding of the blank according to claim 8, wherein the lid top wall counter panel, the first stabilizing flap and the second stabilizing flap are bonded directly to the contact surface of the lid top wall panel opposite the outer surface of the lid top wall panel such that at least a part of the peripheral edge of the first stabilizing flap abuts at least part of the peripheral first edge of the lid top wall counter panel and at least a part of the peripheral edge of the second stabilizing flap abuts at least part of the peripheral second edge of the lid top wall counter panel.

14. A method for forming a pack by folding of the blank according to claim 11, wherein:

the lid top wall counter panel, the first stabilizing flap and the second stabilizing flap are bonded directly to the contact surface of the lid top wall panel opposite the outer surface of the lid top wall panel such that at least a part of the peripheral edge of the first stabilizing flap is aligned with at least part of the peripheral first edge of the lid top wall counter panel and at least a part of the peripheral edge of the second stabilizing flap is aligned with at least part of the peripheral second edge of the lid top wall counter panel;

a lid front wall counter panel is folded about the second folding line and bonded to the lid front wall panel such that the lid front wall panel forms an outer surface of a lid front wall;

a first lid side wall is formed by bonding the first side flap of the first pair and the first side flap of the second pair; and a second lid side wall opposite to the first lid side wall is formed by bonding the second side flap of the first pair and the second side flap of the second pair.

15. A method for forming a pack by folding of the blank according to claim 12, wherein:

the lid top wall counter panel, the first stabilizing flap and the second stabilizing flap are bonded directly to the contact surface of the lid top wall panel opposite the outer surface of the lid top wall panel such that at least a part of the peripheral edge of the first stabilizing flap is aligned with at least part of the peripheral first edge of the lid top wall counter panel and at least a part of the peripheral edge of the second stabilizing flap is aligned with at least part of the peripheral second edge of the lid top wall counter panel;

a lid front wall counter panel is folded about the second folding line and bonded to the lid front wall panel such that the lid front wall panel forms an outer surface of a lid front wall;

a first lid side wall is formed by bonding the first side flap of the first pair and the first side flap of the second pair;

a second lid side wall opposite to the first lid side wall is formed by bonding the second side flap of the first pair and the second side flap of the second pair;

a container back wall is formed of the container back wall panel, wherein the lid is linked with the container back wall via a hinge which is realized by the seventh folding line;

a container bottom wall is formed by bonding the first reinforcement tongue and the second reinforcement tongue to the container bottom wall panel;

a container front wall opposite to the container back wall is formed of the container front wall panel;

a first container side wall is formed by bonding of the first container side flap of the first pair and the first container side flap of the second pair; and a second container side wall opposite to the first container side wall is formed by bonding of the second container side flap of the first pair and the second container side flap of the second pair.

* * * * *